US005249486A

United States Patent [19]

Thompson et al.

[11] Patent Number: 5,249,486

[45] Date of Patent: Oct. 5, 1993

[54] TORQUE WRENCH

[75] Inventors: Ian C. Thompson, Morpeth; David Campbell, Ashington, both of England

[73] Assignee: Hedley Purvis Limited, Northumberland, England

[21] Appl. No.: 16,801

[22] Filed: Feb. 2, 1993

[30] Foreign Application Priority Data

Feb. 10, 1992 [GB] United Kingdom ..... 92027762

[51] Int. Cl.[5] ..... B25B 13/46

[52] U.S. Cl. ..... 81/57.39

[58] Field of Search ..... 81/57.39

[56] References Cited

U.S. PATENT DOCUMENTS 4,982,626 1/1991 More et al. ..... 81/57.39

*Primary Examiner*—D. S. Meislin

*Attorney, Agent, or Firm*—Larson and Taylor

[57] ABSTRACT

A torque wrench comprises a body member containing a piston-cylinder assembly to the piston of which is secured a shuttle member reciprocable with the piston within the body member, and a housing mounted on the body member and including a drive member pivotal about an axis and having a neck portion radially remote from the pivot axis. The shuttle member has a cylindrical bore therein the central longitudinal axis of which extends parallel with the pivot axis of the drive member, said bore housing a cylindrical drive pin in which is formed a transverse bore, the neck portion of the drive member being received within said bore whereby, on linear movement of the piston, the drive member is pivoted about the pivot axis with the neck portion of the drive member undergoing guided sliding movement in the bore of the drive pin, and the drive pin pivoting about the central longitudinal axis of the bore in the shuttle member.

6 Claims, 3 Drawing Sheets

8
24
14
I
22
30
I 38
6
10
2
14
24
8
26
4
16
18
20
34
28
12
22
36
P
32
30

TORQUE WRENCH

BACKGROUND OF THE INVENTION

This invention relates to hydraulic torque wrenches used for rotating mechanical components, for example for tightening or loosening nuts, bolts and screws, and more particularly to wrenches capable of providing a substantially constant torque and of maintaining such a torque over a relatively long stroke of the associated piston.

Our published European specification no. 0382408 discloses a constant torque wrench of this type which includes a body member incorporating a hydraulic piston-cylinder assembly, and a housing incorporating a ratchet drive mechanism. The drive mechanism includes a pivotal drive lever provided with a cylindrical neck portion remote from the pivot axis of the lever, said neck portion being slidably received within the cylindrical bore of a spherical bearing member linearly movable with the piston of the piston-cylinder assembly.

The provision of the spherical bearing member, which is preferably housed within a cylindrical shuttle member secured to, to be movable with, the piston, enables the linear movement of the piston to be translated into angular movement of the drive lever in a manner which achieves substantially constant torque throughout the length of the piston stroke, while at the same time the spherical nature of the bearing member, and the associated substantially universal movement it can undergo, accommodates the torsional and bending forces transmitted through the body member during normal operation.

The above-described tool is particularly suited to dual purpose use for both conventional and limited access situations.

For conventional use, a housing accommodating a square drive is provided to which can be attached a variety of different sockets.

For limited access use, the housing with the square drive is replaced by a low profile housing incorporating a socket of the desired dimensions.

Thus it will be appreciated that the housings should be easily interchangeable such that the exchange can be made without the need for specialised tooling, holding devices and the like.

Although removal of a housing from a body member is readily achieved and attachment of a housing to a body member can be achieved relatively easily with care and experience, situations have arisen whereby care has not been exercised and damage has occurred.

Prior to assembly, it is necessary to locate the spherical bearing member in a position whereby the bore therethrough is positioned to receive therein the neck portion of the drive lever as the housing is mounted on the body member. In view of the substantially universal movement the bearing member can undergo, it is possible for the bore therein to be inadvertently or accidently misaligned with the neck portion of the drive lever whereby assembly cannot be completed until the bearing member is realigned. This problem is exacerbated if, as is preferable, the neck portion of the drive lever is a close sliding fit in the bore through the bearing member.

SUMMARY OF THE INVENTION

It is an object of the invention to provide a constant torque wrench more easily assembled than heretofore.

According to the present invention there is provided a hydraulic torque wrench comprising a body member in which is linearly reciprocable the piston of a hydraulic piston-cylinder assembly, a shuttle member secured to the piston to undergo guided linear reciprocal movement with the piston within the body member, and a housing in which are contained a drive member pivotal by said piston-cylinder assembly about an axis radially spaced from the line of action of the piston, said drive member including a neck portion radially remote from said pivot axis, holding means carried by the drive member to be rotatable co-axially with said drive member, and a ratchet connection between the drive member and the holding means, characterised in that a cylindrical bore is formed in the shuttle member the central longitudinal axis of which extends parallel with the pivot axis of the drive member, and a correspondingly-cylindrical drive pin is located within said bore to be rotatable therein about said central longitudinal axis, the drive pin having a transverse bore formed therein slidably received within which is the neck portion of the drive member, the arrangement being such that, on linear movement of the piston and attached shuttle member, the drive member is pivoted about the pivot axis with the neck portion of the drive member undergoing guided sliding movement in the bore of the drive pin and the drive pin pivoting about the central longituidinal axis of the bore in the shuttle member.

The provision of a cylindrical drive pin rotatable about a single axis within the shuttle member reduces the possibility of misalignment of the bore in the drive pin with the neck portion of the drive member on assembly of the housing and body member.

Preferably the neck portion of the drive member is of cylindrical shape and the bore within the drive pin is of generally oval shape in transverse section with the minor diameter thereof extending parallel with the pivot axis of the drive member and being of a length equal to the diameter of the neck portion, the length of the major diameter exceeding the diameter of said neck portion.

The increased size of the bore in the drive pin compared with size of the neck portion of the drive member provides additional room for movement when locating the neck portion in the drive pin on assembly of the wrench.

Conveniently the longitudinal centreline of the bore through the drive pin is offset from the longitudinal centreline of the drive pin to that side of the longitudinal centreline of the drive pin remote from the piston of the piston-cylinder assembly.

In a preferred embodiment of the invention, the shuttle member is of generally cylindrical shape and is reciprocal within a corresponding cylindrical bore formed within the body member.

The body member is preferably of generally tubular form and includes a one end extent which is externally splined to receive thereon a removable reaction member and which houses the piston of the piston-cylinder assembly, and an other end extent which is externally splined and which houses the shuttle member and the drive pin, the housing being internally splined to be removably mounted on said other end extent of the body member.

Conveniently the body member has associated therewith a first housing containing holding means in the form of a conventional polygonal drive shaft and associated sockets, and a plurality of second housings each containing holding means in the form of a different sized polygonal socket.

DESCRIPTION OF THE PREFERRED EMBODIMENT

Figure 2:
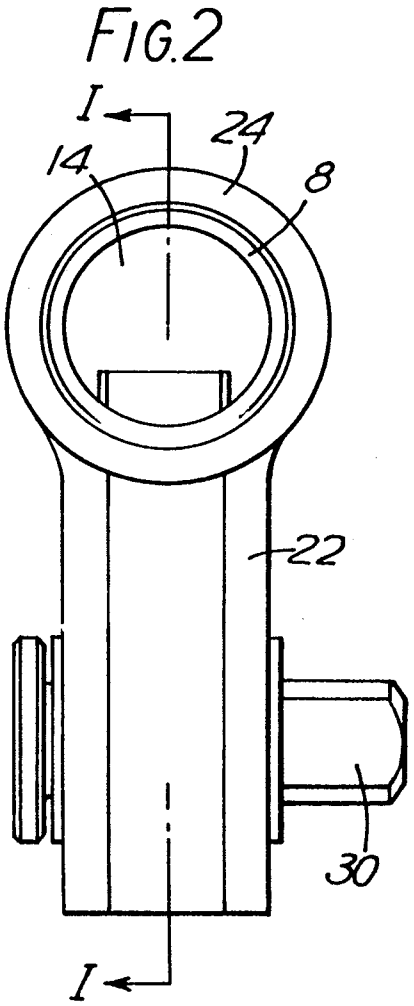
FIG. 2 is a front view of the wrench of FIG. 1 with the front end cap removed.
Figure 1:
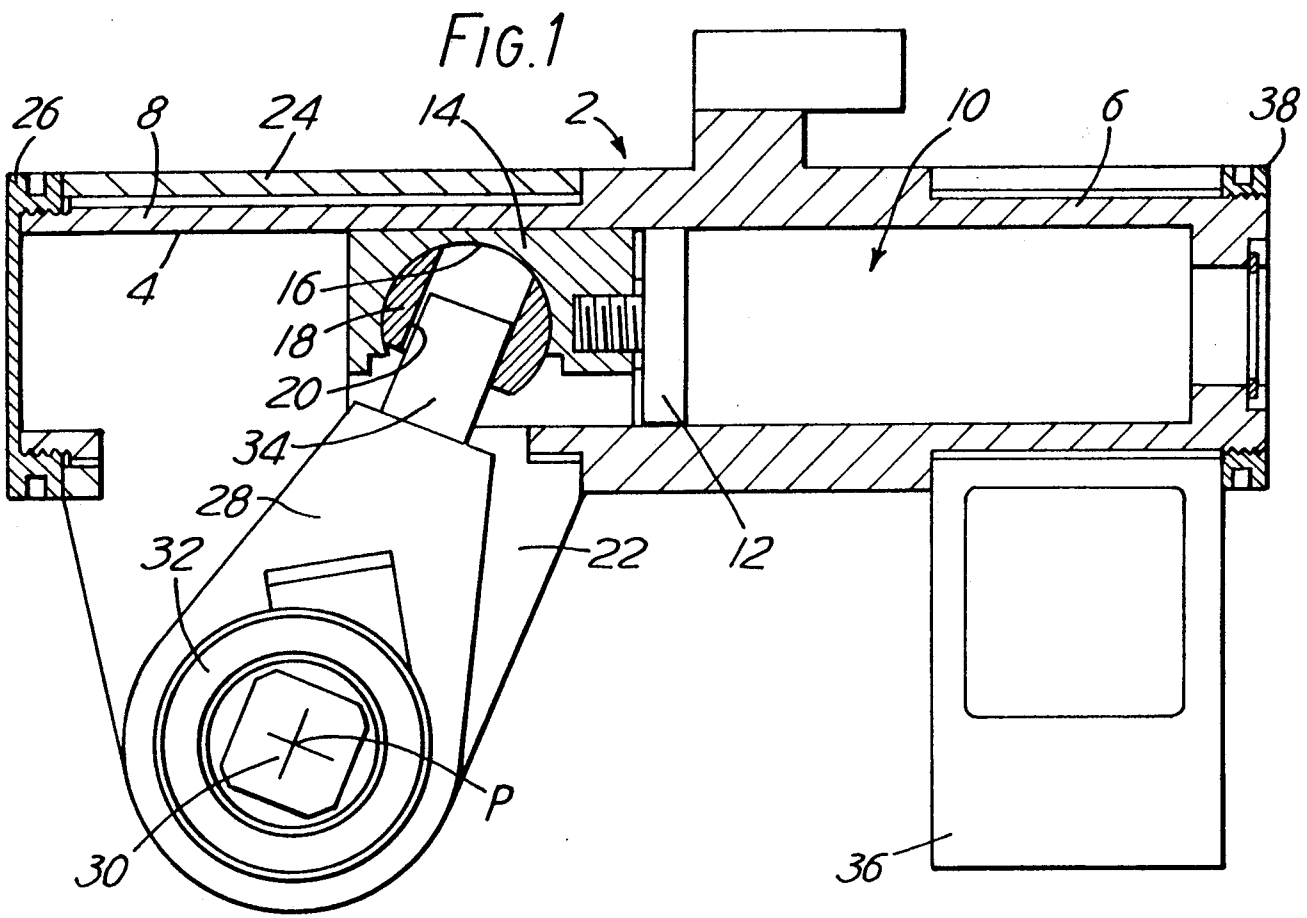
FIG. 1 is a longitudinal vertical section on the line I—I of FIG. 2 through a torque wrench according to the invention.
Figure 3:
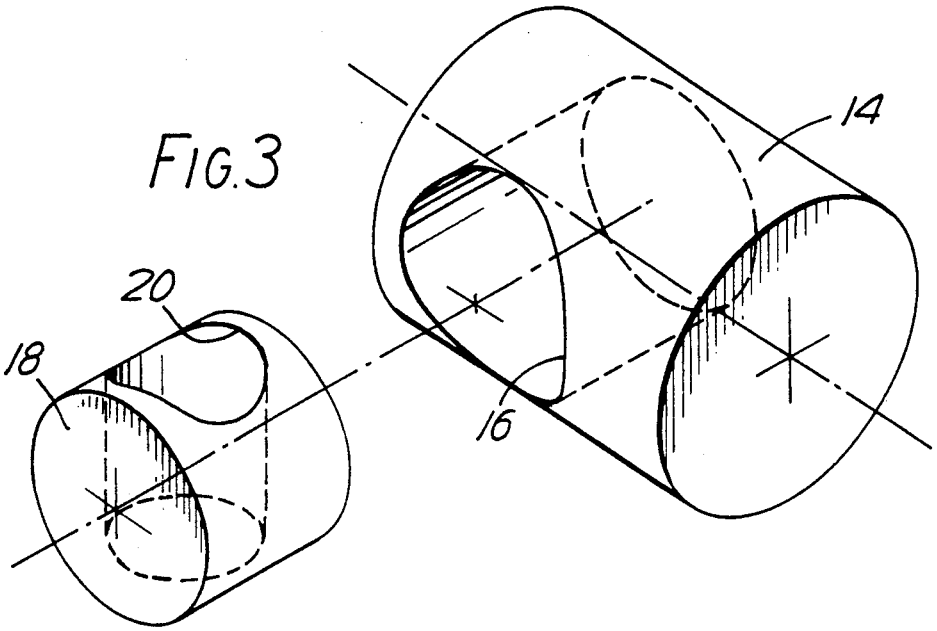
FIG. 3 shows the shuttle member and drive pin prior to location of the drive pin in the bore of the shuttle member.

Referring to FIGS. 1 and 2, the illustrated torque wrench comprises a tubular body member indicated generally at 2 in which is machined a cylindrical bore 4. The body member 2 includes a first end portion 6 of reduced external diameter and a second end portion 8 also of reduced external diameter, said portions 6 and 8 being externally splined for reasons which will become apparent.

A hydraulic piston-cylinder assembly indicated generally at 10 is located in one end of the bore 4 of the body member 2, the front end of the piston rod being shown at 12.

Secured, for example by screwing, to the piston rod 12 is a shuttle member 14 of generally cylindrical shape which, on reciprocating movement of the piston, is positively guided by the bore 4 for linear reciprocating sliding movement therein.

Figure 4:
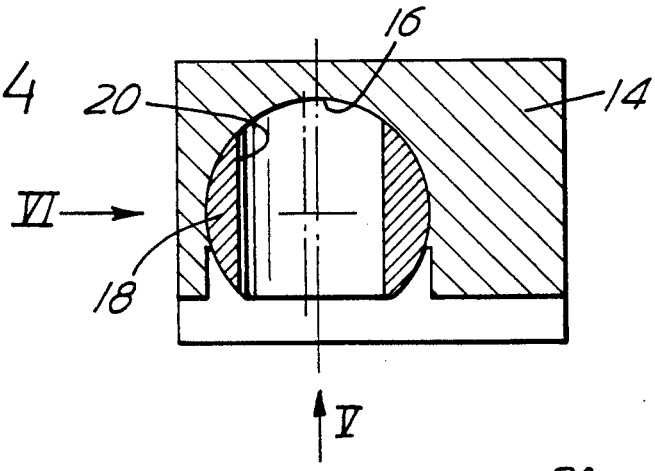
FIG. 4 is a longitudinal vertical section through the shuttle member/drive pin assembly.

A cylindrical bore 16 is formed transversely through the shuttle member 14, the central longitudinal axis of which bore 16 extends perpendicular to the line of action of the piston of the assembly 10, said bore 16 being downwardly open as best seen in FIG. 4.

Housed within the bore 16 is a correspondingly-cylindrical drive pin 18 which can rotate within the bore 16 about the common central longitudinal axis of the bore 16 and the drive pin 18.

Figure 5:
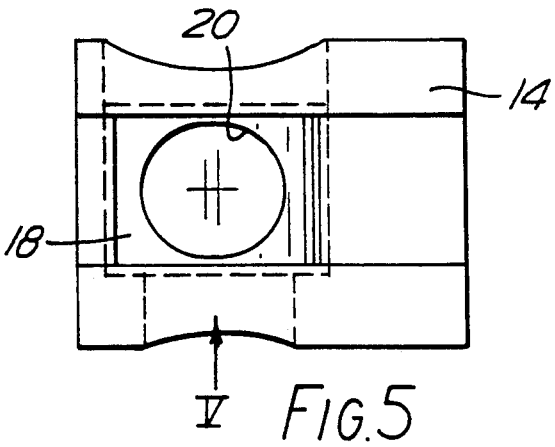
FIG. 5 is an underside view in the direction of arrow V of the assembly of FIG. 4.
Figure 6:
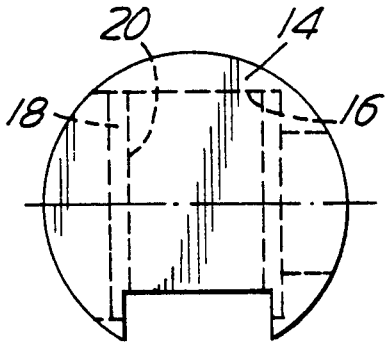
FIG. 6 is a front view in the direction of arrow VI of the assembly of FIG. 4.

A further bore 20 extends diametrically through the drive pin 18 perpendicular to the central longitudinal axis thereof, the cross-section of the bore 20 being of generally oval shape as best seen in FIG. 5, being diametrically extended in the direction of movement of the shuttle member 14.

The wrench further includes a housing 22 including an internally splined cylindrical portion 24 adapted to be positioned over the second end portion 8 of the body member 2 to locate the housing 22 in its operative position. The housing 22 is retained on the portion 8 of the body member 2 by means of an end cap 26 screwed onto the end of the portion 8.

The housing 22 contains therein the drive mechanism of the wrench. More particularly this mechanism comprises a pivotal drive lever 28 in which is housed a square drive shaft 30, a ratchet 32 interconnecting the lever 28 and shaft 30 in conventional manner. The lever 28 and shaft 30 are pivotal about the point P.

The drive lever 28 includes, at a region remote from the point P, a cylindrical neck portion 34 the central axis of which extends radially of the point P. The neck portion 34 is slidably received in the bore 20 in the drive pin 18 to effect a connection between the hydraulic piston-cylinder assembly 10 and the drive mechanism. More particularly, the diameter of the cylindrical neck portion 34 is equal to the length of the minor axis of the bore 20, while the centre of the major axis of the bore 20 is located to the side of the centreline of the drive pin 18 remote from the piston-cylinder assembly 10.

A removable internally splined reaction member 36 is mounted on the first end portion 6 of the body member 2 and is retained thereon by an end ring 38 screwed onto the end of the portion 6.

On movement of the piston of the assembly 10 to the left as viewed in FIG. 1, the shuttle member 14 and drive pin 18 are moved linearly whereby the rear region of the surface of the bore 20 in the drive pin engages the neck portion 34 of the drive lever 28. The lever 28 is constrained to pivot about the point P, and the neck portion 34, as it arcs about the point P, moves radially upwardly and then downwardly relative to the line of action of the piston, this arcing movement of the neck portion 34 being accommodated by the drive pin 18 which rotates in the bore 16 in the shuttle member 14 about the central longitudinal axis of the bore 16 which intersects the line of action of the piston. The ratchet 32 between the drive lever 28 and the shaft 30 ensures that the shaft 30 is rotated with the lever 28 on anti-clockwise rotation of the lever 28 as viewed in FIG. 1 and remains stationary during return clockwise rotation of the lever 28, all in conventional manner.

Figure 7:
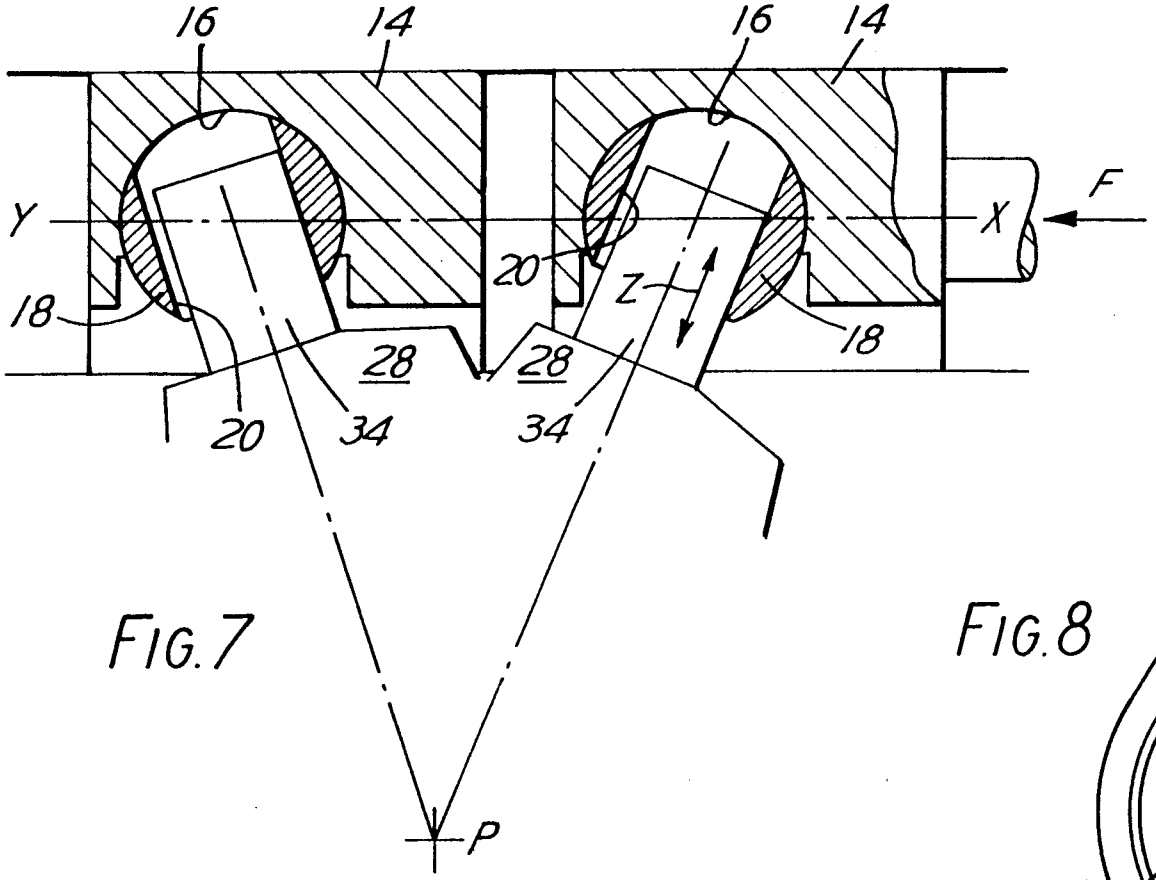
FIG. 7 illustrates the positions of the shuttle member, the drive pin and the neck portion of the drive member of the wrench of FIGS. 1 and 2 at the extremeties of their reciprocating movement.

FIG. 7 illustrates the shuttle member 14 and neck portion 34 of the drive lever 28 at both the beginning and the end of the power stroke of the piston. The force F supplied by the piston-cylinder assembly 10 acts along the line XY which passes centrally through the shuttle member 14 and the drive pin 18. The arrow Z shows the direction of sliding movement of the neck portion 34 in the drive pin 18, the arrangement being such as to maintain, for a given force F, a substantially constant torque about the point P throughout the stroke of the piston-cylinder arrangement 10.

Conveniently each body member 2 has associated therewith a plurality of further housings 22 whereby the wrench illustrated in FIGS. 1 and 2 can be converted from the conventional square drive mode to any one of a plurality of slim-line modes, each slim-line housing incorporating a different hexagonal socket rather than a square drive shaft 30.

Figure 8:
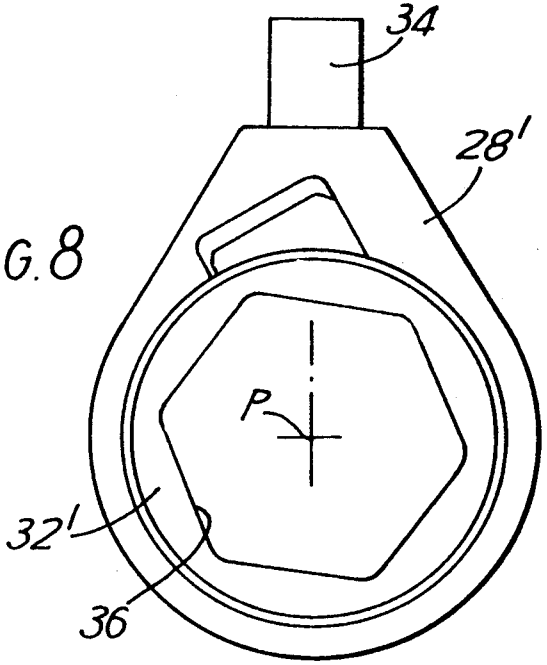
FIG. 8 illustrates alternative holding means to those shown in the torque wrench of FIGS. 1 and 2.

More particularly each further housing 22 includes a pivotal drive lever 28' as seen in FIG. 8 in which is housed a hexagonal socket 36, a ratchet 32' interconnecting the lever 28' and the socket 36 in conventional manner. The lever 28' and the socket 36 are pivotal about the point P.

A major advantage of the above-described torque wrench over known interchangeable arrangements is that assembly of the housing onto the body member 2 is much more readily achieved whilst still retaining the substantially constant torque feature.

More particularly and prior to locating the housing 22 on the second end portion 8 of the body member 2, the drive pin 18 and shuttle member 14 are located substantially as shown in FIGS. 1 and 2—i.e. with the bore 20 in the drive pin tilted downwardly and forwardly of the wrench and with the shuttle member 14 located symmetrically in the bore 4.

The housing 22 is slid along the portion 8 of the body member and at the same time the drive lever 28 is pivoted from a substantially horizontal position whereby the neck portion thereof passes through the aperture in the lower wall of the body portion 8 and is then guided into the bore 20 in the drive pin 18. When the housing is fully located on the body member 2 with the neck portion 34 fully located in the drive pin 18, the end cap 26 is fitted to the body member 2.

The drive pin 18 can only rotate about a single axis relative to the shuttle member 14 and consequently inadvertent misalignment of bore 20 therein during assembly of the torque wrench is considerably less likely to occur than with a spherical bearing member, while the increased diameter of the bore 20 in the fore and aft direction of the wrench compared with the diameter of the cylindrical neck portion 34 provides increased clearance between the neck portion 34 and the bore 20 thus further facilitating assembly.

On actuation of the wrench and on forward movement of the shuttle member 14, the drive pin 18 will automatically align itself such that the bore 20 in the drive pin 18 and the neck portion 34 of the drive lever 28 are square to each other thus ensuring that the contact surface area between the drive pin 18 and the neck portion 34 is at a maximum.

Any torsional stresses established in the wrench during operation are accommodated by the shuttle member 14 which, being of a cylindrical shape, can rotate within the bore 4 of the body member 2 about the central longitudinal axis thereof.

Although it is preferred that there is a clearance between the neck portion 34 and the bore 20, said neck portion 34 may be a close fit in said bore 20.

Additionally the neck portion 34 may be other than of circular cross-section, for example oval, polygonal or the like with the bore 20 in the drive pin 18 being correspondingly shaped.

Furthermore, the shuttle member 14 may be other than cylindrical with the bore of the second end extent 8 of the body member 2 being correspondingly shaped.

Other modifications and variations from the described and illustrated arrangement will be apparent to those skilled in the art.

What we claim and desire to secure by Letters Patent is:

1. A hydraulic torque wrench comprising a body member, a hydraulic piston-cylinder assembly having a piston linearly reciprocal within the body member along a line of action, a shuttle member secured to the piston to undergo guided linear reciprocal movement with the piston within the body member, and a housing in which are contained a drive member pivotal by said piston-cylinder assembly about an axis radially spaced from the line of action of the piston, said drive member including a neck portion radially remote from said pivot axis, holding means carried by the drive member to be rotatable co-axially with said drive member, and a ratchet connection between the drive member and the holding means, the shuttle member defining therein a cylindrical bore having a central longitudinal axis extending parallel with the pivot axis of the drive member, the wrench further comprising a cylindrical drive pin located within said bore in the shuttle member to be rotatable therein about said central longitudinal axis, the drive pin defining therein a transverse bore slidably received within which is the neck portion of the drive member, the arrangement being such that, on linear movement of the piston and attached shuttle member, the drive member is pivoted about the pivot axis with the neck portion of the drive member undergoing guided sliding movement in the bore of the drive pin, and the drive pin pivoting about the central longitudinal axis of the bore in the shuttle member.

2. A torque wrench as claimed in claim 1 in which the neck portion is of cylindrical shape and the bore within the drive pin is of generally oval shape in transverse section and has a minor diameter and major diameter, the minor diameter thereof extending parallel with the pivot axis of the drive member and being of a length equal to the diameter of the neck portion, the length of the major diameter exceeding the diameter of said neck portion.

3. A torque wrench as claimed in claim 2 in which the longitudinal centreline of the bore through the drive pin is offset from the longitudinal centreline of the drive pin to that side of the longitudinal centreline of the drive pin remote from the piston of the piston-cylinder assembly.

4. A torque wrench as claimed in claim 1 in which the shuttle member is of generally cylindrical shape, the body member defining therein a corresponding cylindrical bore in which the shuttle member is reciprocal.

5. A torque wrench as claimed in claim 1 in which the body member is of generally tubular form and includes a one end extent which is externally splined and which houses the piston of the piston-cylinder assembly, a removable reaction member being mounted on said one end extent, and an other end extent which is externally splined and which houses the shuttle member and the drive pin, the housing being internally splined to be removably mounted on said other end extent of the body member.

6. A torque wrench as claimed in claim 5 and including a plurality of interchangeable housings, a first one containing holding means in the form of a conventional polygonal drive shaft and associated sockets, and the others each containing holding means in the form of a different size polygonal socket.

* * * * *